United States Patent [19]

Ensmann et al.

[11] 4,291,877

[45] Sep. 29, 1981

[54] TOY VEHICLE ENGINE SOUND DEVICE

[75] Inventors: Burt W. Ensmann, Flushing; Fredric M. Kuriloff, New York; William Rosenhagen, Ossining, all of N.Y.

[73] Assignee: Ideal Toy Corporation, Hollis, N.Y.

[21] Appl. No.: 109,718

[22] Filed: Jan. 4, 1980

[51] Int. Cl.[3] ..... A63F 9/14; A63H 5/00

[52] U.S. Cl. ..... 273/86 B; 46/232

[58] Field of Search ..... 273/86 B; 46/227, 232; 104/295, 296, 304, 305

[56] References Cited

U.S. PATENT DOCUMENTS

| | | | |
|---|---|---|---|
| 2,882,834 | 4/1959 | Smith | 46/232 UX |
| 3,165,595 | 1/1965 | Noshiro | 46/232 UX |
| 3,339,307 | 9/1967 | Floyd et al. | 46/232 X |
| 3,425,156 | 2/1969 | Field | 46/232 |
| 3,664,060 | 5/1972 | Longnecker | 46/232 |

*Primary Examiner*—Anton O. Oechsle

*Attorney, Agent, or Firm*—Richard M. Rabkin

[57] ABSTRACT

An engine-sound accessory for an electric toy vehicle produces a sound output which varies its characteristics in proportion to an electric input to the toy vehicle. The apparatus measures the total electric current fed to the toy vehicle to produce a sound control signal proportional thereto. When two or more vehicles are fed from a common power source, the apparatus is responsive to the sum of the electric current fed to the two or more vehicles whereby variation in the electric current fed to one or both of the vehicles produces a corresponding variation in the sound characteristic.

13 Claims, 4 Drawing Figures

TOY VEHICLE ENGINE SOUND DEVICE

BACKGROUND OF THE INVENTION

The present invention relates to toy vehicles.

More particularly, the present invention relates to an engine-sound accessory for an electric toy vehicle.

In toy vehicle games such as, for example, the familiar slot car and slotless car racing games, two or more participants individually control the speed of different toy vehicles. Toy vehicle manufacturers have attempted to attain the maximum realism in their games within physical and economic constraints. Such desire for realism has resulted in the introduction of slotless car racers which, although constrained to a track, are capable of changing lanes. Such slotless car racers are disclosed in U.S. Pat. No. 4,078,799.

Each participant feeds a variable voltage to his controlled vehicle usually using a hand control apparatus containing a variable resistor. In response to the varying voltage fed thereto, the torque or acceleration applied to the toy vehicle is varied.

As a further attempt to enhance the realism of such toy vehicles, U.S. Pat. No. 3,425,156 discloses an engine sound simulator which employs the voltage fed to the track of a toy vehicle to control the frequency of a relaxation oscillator for generating a signal which, when amplified, drives a loudspeaker to simulate sound.

An engine sound simulator such as disclosed in the prior art, provides an artificial sound which is responsive only to the voltage fed to the toy vehicle and is not directly related to the torque or acceleration thereof.

OBJECTS AND SUMMARY OF THE INVENTION

It is an object of the present invention to provide an engine sound accessory for an electric toy vehicle which overcomes the drawbacks of the prior art.

It is a further object of the present invention to provide an engine sound apparatus for an electric toy vehicle which produces a realistic engine sound having characteristics related to the torque or acceleration of the toy vehicle.

It is a further object of the invention to provide an engine sound apparatus for an electric toy vehicle game in which a plurality of toy vehicles are independently driven by control devices and the sound apparatus is responsive to the sum of the currents fed to the plurality of toy vehicles.

According to an aspect of the invention, there is provided an electric toy vehicle system of the type in which at least one controller controls electric power to at least one toy vehicle, comprising means for sensing current in the electric power, and means for producing an acoustic output having a characteristic which is varied in response to the means for sensing current.

According to another aspect of the invention, there is provided an acoustic accessory for an electric toy vehicle game of the type having an ac power source, at least first and second electric toy vehicles and first and second controllers independently operable to control at least the amplitude of power applied to respective electric toy vehicles, comprising means for sensing the total current applied to the first and second electric toy vehicles, and means for producing an acoustic output having a characteristic which is varied in response to the means for sensing.

According to a feature of the invention, there is provided a method of producing a variable engine sound in a toy vehicle game of the type having at least one electric toy vehicle whose speed can be controlled by varying an electric voltage and current fed thereto, comprising the steps of recording a sound of a motor vehicle operating at full speed on a magnetic recording medium moving at a predetermined speed, sensing the electric current fed to the at least one toy vehicle and producing a drive signal in response thereto, driving the magnetic recording medium at a speed which is responsive to the drive signal, and reproducing the sound from the recording medium.

The above, and other objects, features and advantages of the present invention, will become apparent from the following description read in conjunction with the accompanying drawings in which like reference numerals designate the same elements.

DETAILED DESCRIPTION OF THE PREFERRED EMBODIMENT

Figure 1:
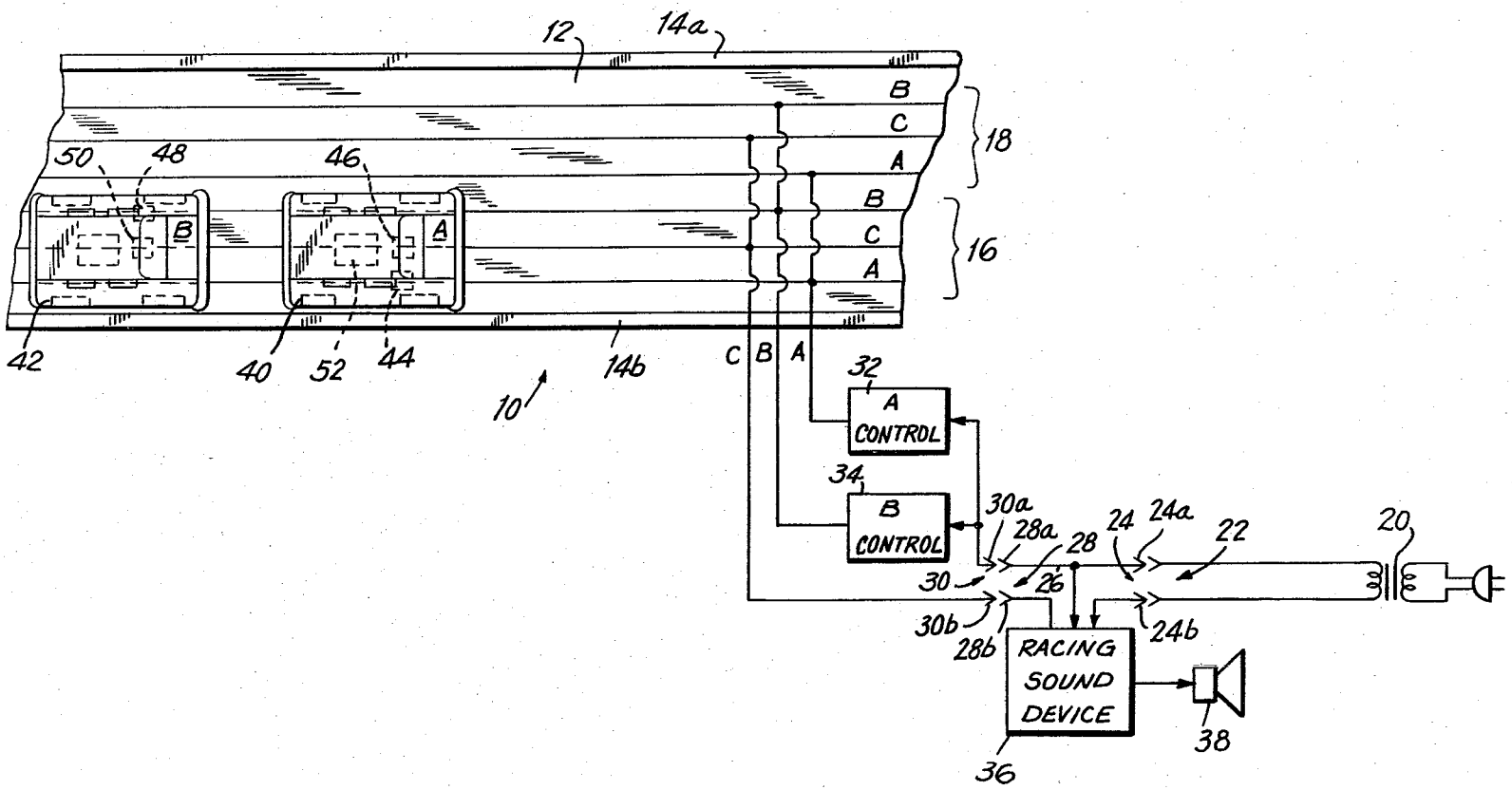
FIG. 1 is a partial schematic partial plan view of a track of a toy vehicle game including two vehicles thereon and the control system therefor including a racing sound device according to the present invention.

Referring now to FIG. 1, there is shown one embodiment of a toy vehicle game in which a slotless track, shown generally at 10, includes a roadbed 12 having first and second edge barriers 14*a*, 14*b* extending thereabove.

Although the present invention is equally applicable to toy vehicle games in which the power is applied to the toy vehicles through slots or by other means, for concreteness, the present invention is described in connection with a slotless track in which first and second lanes 16 and 18 each have pick-up rails A, B and C which are embedded substantially flush with the surface of roadbed 12. It will be seen that corresponding pick up rails in lanes 16 and 18 are interconnected.

An alternating power source such as, for example, a transformer 20, provides AC power to a first 2-pin connector 22 which is mated to a second 2-pin connector 24. One of the pins 24*a* of 2-pin connector 24 is connected via conductor 26 to a pin 28*a* of a 2-pin connector 28. Pin 28*a* is mated with a pin 30*a* of a 2-pin connector 30. Pin 30*a* is connected to inputs of an A controller 32 and a B controller 34. As shown, an output of A controller 32 is connected in parallel to the two A pickup rails on roadbed 12 and an output of B controller 34 is connected in parallel to the two B pickup rails in roadbed 12. A pin 24*b* of 2-pin connector 24 is connected to a racing sound device 36. An output of racing sound device 36 is connected to pin 28*b* of 2-pin connector 28 which is, in turn, mated to a pin 30*b* of 2-pin connector 30. Pin 30*b* is connected in parallel to the C pickup rails in roadbed 12. A second output of racing sound device 36 is applied to a loudspeaker 38.

An A car 40 and a B car 42 are disposed in lane 16. A car 40 picks up power from pickup rails A and C via pickup shoes 44 and 46. B car 42 picks up power from pickup rails B and C via pickup shoes 48 and 50. It should be noted that A car 40 and B car 42 can be independently operated since they are fed power from different pickup rails.

As is conventional, A car 40 and B car 42 are normally biased against one of the edge barriers, for example, edge barrier 14*b* and, by manipulation of their respective controllers 32 or 34, can be turned out of lane 16 into lane 18 wherein they are biased into guiding contact with edge barrier 14*a*. This manuever is useful for passing. The corresponding locations of pickup rails A, B and C in lanes 16 and 18 permits continued independent control of A car 40 and B car 42 through the respective pickup rails in either lane. The slotless cars described in the foregoing are conventional and further details of their construction and operation can be found in U.S. Pat. No. 4,078,799, the disclosure of which is herein incorporated by reference.

As would be evident from an inspection of FIG. 1, if connectors 22 and 24 and 28 and 30 were disconnected and connector 22 were mated with connector 30 to thus eliminate racing sound device 36 from the circuit, a conventional slotless racing system would be provided.

Figure 2:
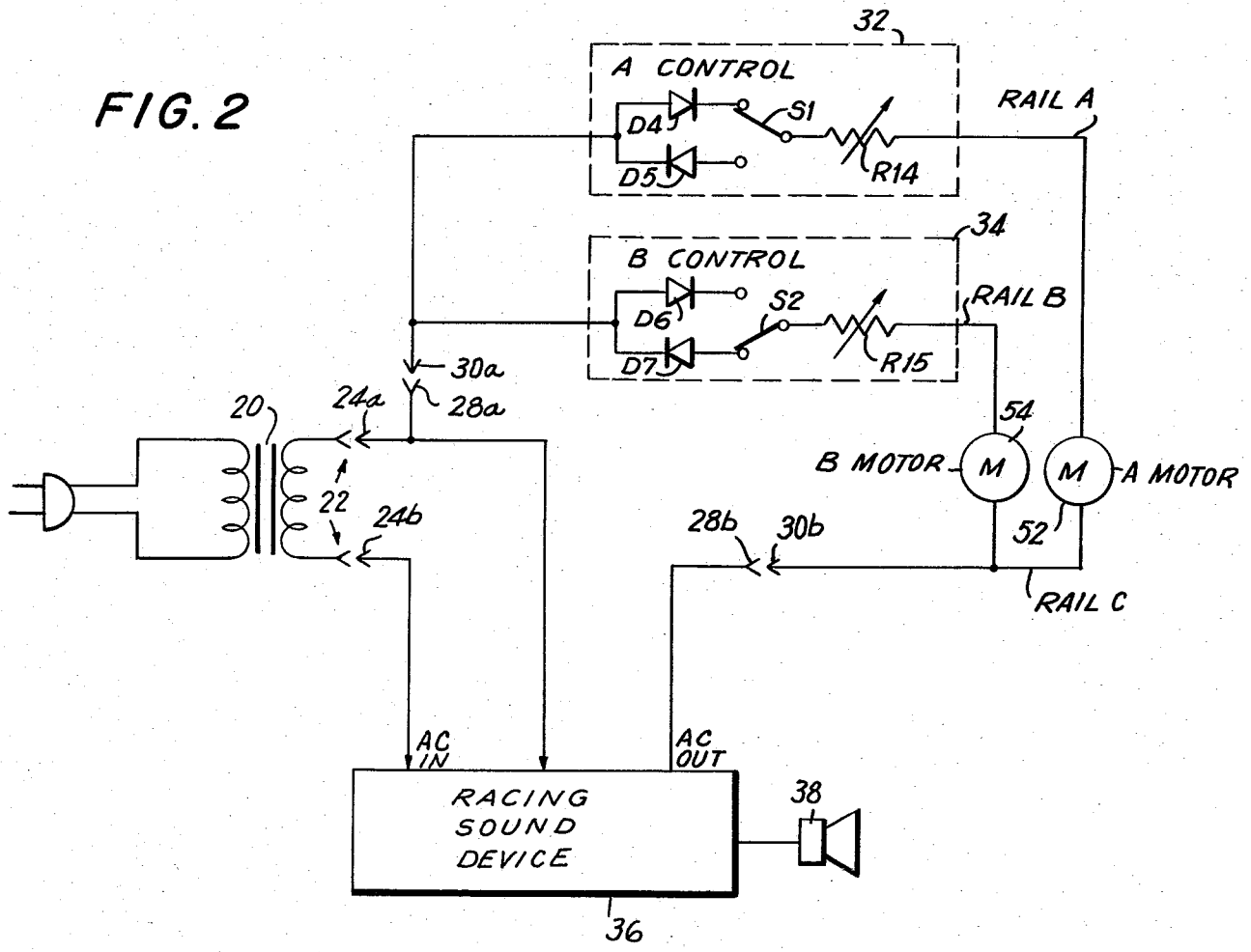
FIG. 2 is a simplified schematic diagram of the power supply, controllers and car motors showing their connections to the racing sound device of the present invention.

Referring now to FIG. 2, wherein like reference numerals describe like apparatus, a motor 52 of car A is shown directly connected between rail A and rail C. Pickup shoes 44 and 46 (FIG. 1) are omitted for simplicity. Similarly a motor 54 of car B is shown directly connected between rail B and rail C.

Since A controller 32 and B controller 34 are virtually identical, only A controller 32 will be described in detail. The differences between A controller 32 and B controller 34 will then be discussed.

A controller 32 contains a pair of oppositely poled diodes D4 and D5 connected to the AC power from pin 30*a* of 2-pin connector 30. A single-pole double-throw switch S1 selects either the positive half cycles of power available through diode D4 or the negative half cycles of power available through diode D5 for application to a variable control resistor R14. Variable control resistor R14 is manipulable by the operator to vary the voltage of the half cycles of alternating current which are fed to rail A and thus to motor 52. In this fashion, control resistor R14 is operative to vary the voltage fed to motor 52 and thus vary the current fed through motor 52. The movable contact of switch S1 may be changed to provide negative half cycles of power through diode D5 and control resistor R14 to motor 52. As described in the referenced U.S. patent, such reversal of polarity may be employed to change lanes. Switch S1 may conveniently be spring loaded in the position shown and may be momentarily switched to its alternate position by the operator.

B controller 34 is different from A controller 32 only in the normal position of single-pole doublethrow switch S2. As can be seen, the normal position of switch S2 provides negative half cycles of power to motor 54 rather than the positive half cycles of power normally fed to motor 52. This arrangement equalizes the load on the transformer and is the preferred embodiment, however, it is neither necessary nor does it form a part of the present invention.

Figure 3:
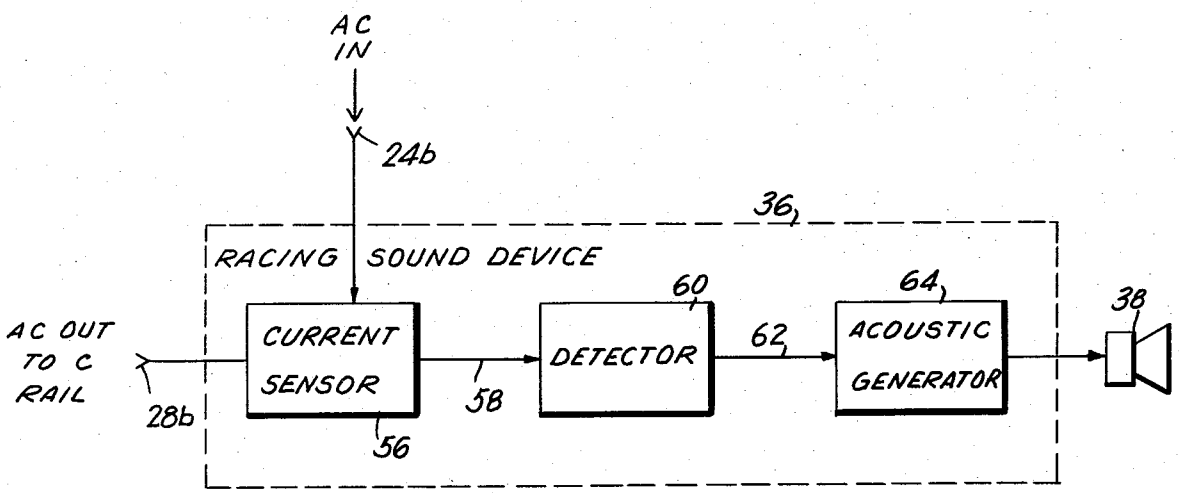
FIG. 3 is a block diagram of the racing sound device of FIGS. 1 and 2.

Referring now to FIG. 3, there is shown a simplified block diagram of racing sound device 36. A current sensor 56 is interposed in the path of alternating current between pins 24*b* and 28*b*. Current sensor 56 presents a very low internal resistance to the current passing therethrough so that, for all practical purposes, the performance of the toy vehicles is substantially the same whether or not racing sound device 36 is in the circuit. Current sensor 56 produces an alternating current signal on an output line 58 which is applied to a detector 60. The alternating current signal on line 58 has an amplitude which varies in proportion to the total current flowing through current sensor 56 to the C pickup rail. Detector 60 detects the alternating current signal at its input and produces a proportional DC signal on its output line 62 which is applied to an input of an acoustic generator 64. Acoustic generator 64 produces an electrical signal having characteristics which are varied in response to the signal on output line 62 and which is applied to loudspeaker 38.

Acoustic generator 64 may be any convenient analog or digital sound frequency generator, such as for example, a relaxation oscillator, microprocessor, or one or more sine-wave generators whose outputs are variously mixed. However, in the preferred embodiment, acoustic generator 64 includes a continuous loop of magnetic tape on which there has been recorded, while the tape is driven at a predetermined or standard speed, an audio signal representing the full-throated roar of a racing car at full speed, and a magnetic pickup apparatus for playback or reproduction of such audio signal on the continuous magnetic tape loop. When the tape loop is driven at slow speed, it has been discovered that the reproduction of the slowed-down tape recording of a racing car is a very good approximation of an idling racing car engine. In addition, since magnetic pickup devices are normally less efficient at low speed, the idling sound thus produced is at a lower amplitude. As the signal to acoustic generator 64 increases, the tape speed is increased and the idling sound produced by the moving magnetic tape is increased in pitch to match the realistic sound of a full speed racing car and, at the same time, as the pickup head becomes more efficient with increasing tape speed, the amplitude also increases without requiring additional circuitry to produce this realistic effect.

It would be evident to one skilled in the art in the light of the present disclosure, that the current passing through current sensor 56 during operation of a single toy vehicle on the track is lower than the current during operation of two toy vehicles on the track. Since current sensor 56 responds to the total current being drawn by the two cars, control manipulation by either operator produces a realistic change in the pitch and amplitude of the sound produced which is a very good approximation of the change which would be heard in a real environment due to the change of torque or acceleration applied to one racing car while the other car maintains constant speed.

Furthermore, it is well known to use a drone or jam car continuously circling the track which is not in control of either operator to increase the excitement of the game. The drone car may receive power from some combination of pickup rails A, B and C but typically has a relatively low power consumption as compared to the controlled cars. The present invention is responsive to the presence of the drone car as well as to the controlled cars. However, since the drone car normally consumes a small amount of current, its contribution does not overpower the variable current controlled by the operators. Motors 52 and 54 (FIG. 2) require a higher current for a given voltage when turning slowly as compared to when turning rapidly. For example, when stopped or moving slowly and then given a rapid increase in drive voltage, a relatively high current flows through the respective motor to produce a torque for accelerating the vehicle. Once the vehicle has increased to its final speed (resulting in an increase in motor speed), the current for the applied voltage automatically reduces. Thus, during acceleration, the higher current produces a more intense sound from acoustic generator 64 and realistically simulates the deep throated roar of a racing engine during acceleration which thereafter is reduced somewhat when running speed is reached.

Figure 4:
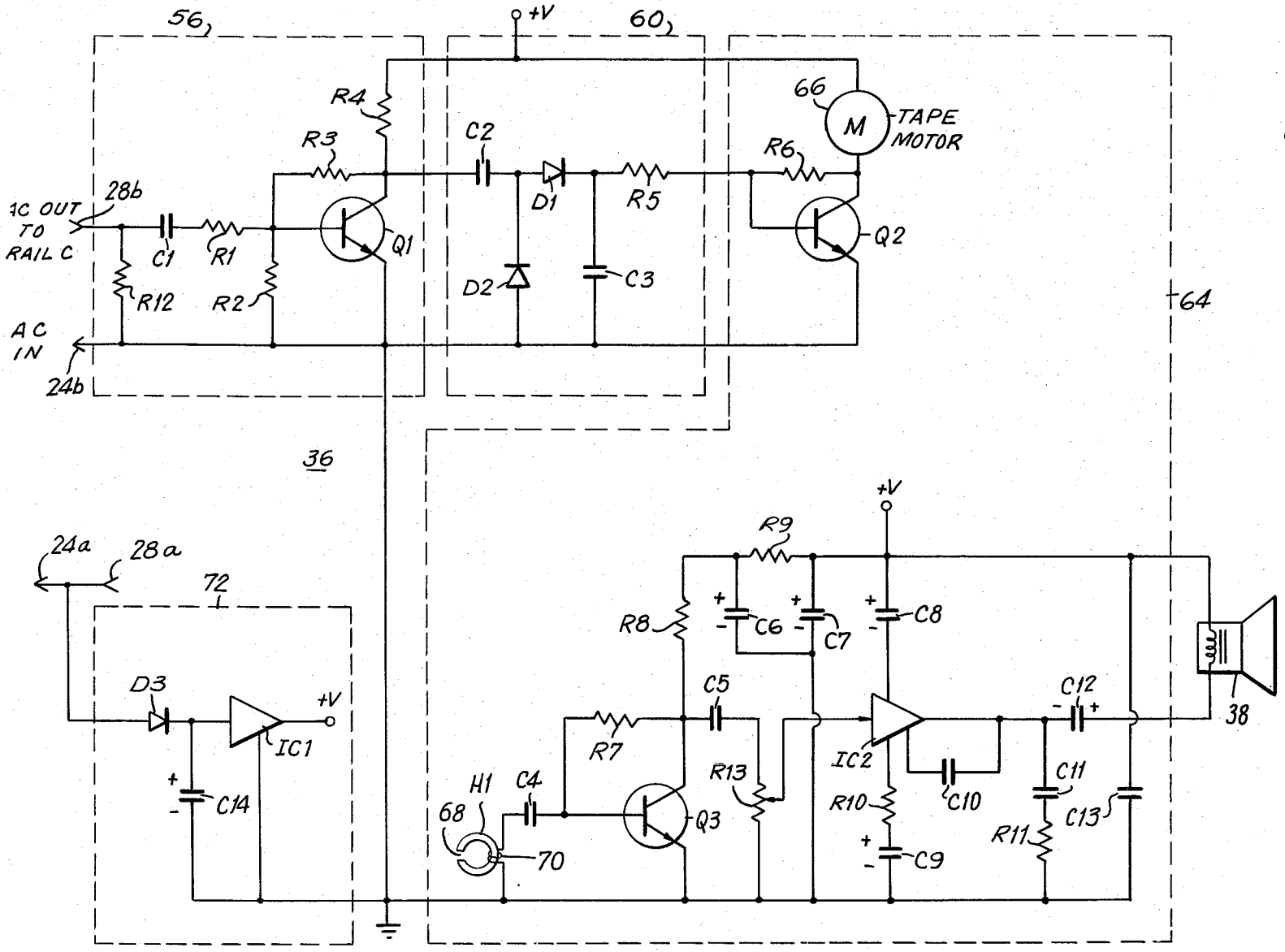
FIG. 4 is a detailed schematic diagram of the racing sound device according to the present invention.

Referring now to FIG. 4, the current fed through current sensor 56 to the C pickup rail passes through a resistor R12 having a small resistance. The resistance of resistor R12 is so small that it has negligible effect on the performance of the toy vehicles. For example, resistor R12 may be 0.5 ohms. With such a resistance value, a voltage is developed across resistor R12 equal to ½ volt per ampere of current. The alternating current voltage developed across resistor R12 is applied through capacitor C1 and resistor R1 to the base of a transistor Q1. Transistor Q1 linearly amplifies the alternating signal applied to its base and the result is fed through a coupling capacitor C2 to the junction of a pair of diodes D1 and D2. As connected, diodes D1 and D2 produce a positive alternating signal which is applied to smoothing capacitor C3. A voltage is thus stored in smoothing capacitor C3 which is proportional to the sum of the alternating currents fed through current detector 56 regardless of the polarity of the half cycles of power applied to the two vehicles. The voltage stored in smoothing capacitor C3 is fed through a resistor to the base of a drive transistor Q2. Drive transistor Q2 has its emitter and collector path in series from a plus supply voltage +V and a tape drive motor 66 to ground. Thus, as more voltage is fed to the base of drive transistor Q2, the resistance in its emittercollector path decreases and the speed of tape drive motor 66 increases. As the speed of tape drive motor 66 increases, the speed of a magnetic recorded medium, such as a loop of magnetic tape (not shown) also increases. A reproducing head H1 having a gap 68 and a winding 70 detects the sound recorded on the magnetic recording medium (not shown) and applies the resulting alternating signal through a capacitor C4 to the base of a transistor Q3. The audio signal developed at the collector of transistor Q3 is coupled through a capacitor C5 and appears across a variable resistor R13. A proportion of the signal appearing across variable resistor R13 is picked off by a movable wiper thereof and is applied to an input of an amplifier IC2. The output of amplifier IC2 is coupled through a capacitor C12 to loudspeaker 38. Frequency shaping components R10 and R11 and C9–C11 are optionally provided to shape the acoustic output as desired for enhanced realism.

Instead of a loop of magnetic tape, a disc of magnetic recording material having the engine sound recorded on a circular track thereof may be used. The disc may be directly or indirectly connected to the shaft of tape drive motor 66, and rotated in proximity to reproducing head H1.

A regulated DC power supply 72 provides a regulated positive voltage +V for use elsewhere in the circuit, as indicated above. The AC power tapped off between pins 24*a* and 28*a* is half-wave rectified in a diode D3, smoothed in a capacitor C14 and applied to a standard integrated circuit voltage regulator IC1. The output of voltage regulator IC1 is a regulated DC voltage, suitably of 12 volts.

The following list of parts presents values thereof in one embodiment of the present invention which has been reduced to practice:

| CAPACITORS (MICROFARADS) | | RESISTORS (OHMS) | |
|---|---|---|---|
| C1 | 0.1 | R1 | 220K |
| C2 | 0.1 | R2 | 560K |
| C3 | 0.1 | R3 | 2.2M |
| C4 | 0.1 | R4 | 10K |
| C5 | 0.1 | R5 | 2.2M |
| C6 | 50 | R6 | 4.7M |
| C7 | 100 | R7 | 2.2M |
| C8 | 50 | R8 | 10K |
| C9 | 100 | R9 | 510 |
| C10 | 0.22 | R10 | 56 |
| C11 | 0.2 | R11 | 1.0 |
| C12 | 220 | R12 | 0.5 |
| C13 | 0.1 | R13 | 10K Variable |
| C14 | 220 | R14 | Variable |
| | | R15 | Variable |
| TRANSISTORS | | | |
| Q1 | MPS A13 | IC1 | 7812 12V Voltage Reg. |
| Q2 | MPS A13 | IC2 | μA 7307 |
| Q3 | MPS A13 | | |
| DIODES | | | |
| D1 | IN4148 | | |
| D2 | IN4148 | | |
| D3 | IN4148 | | |
| D4 | | | |
| D5 | | | |
| D6 | | | |
| D7 | | | |

Having described specific preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An electric toy vehicle system of the type in which at least one controller controls electric power to at least one toy vehicle, comprising:

means for sensing current in said electric power; and means for producing an acoustic output having a characteristic which is varied in response to said means for sensing current;

said means for sensing current including a resistor in series with said electric power, said resistor being operative to develop a voltage thereacross in response to said current; and wherein said electric current is alternating current, said voltage is an alternating voltage, and said means for sensing current further includes means for detecting said alternating voltage.

2. A system according to claim 1; wherein said means for producing an acoustic output includes a moveable magnetic medium having a signal recorded thereon, drive means for driving said magnetic medium at a speed responsive to said means for sensing current, and means for reproducing said signal from said magnetic medium.

3. A system according to claim 2; wherein said moveable magnetic medium is a loop of magnetic tape.

4. A system according to claim 2; wherein said signal is a sound of a real vehicle of a type corresponding to said toy vehicle, said real vehicle being operated at high speed.

5. A system according to claim 4; wherein said drive means is operative to drive said magnetic medium at a speed which reproduces said sound at a pitch substantially corresponding to a pitch at which it was recorded when said at least one controller controls said at least one toy vehicle at its maximum vehicle speed and is operative to drive said magnetic medium at a proportionately slower speed in response to slower toy vehicle speeds.

6. A system according to claim 5; wherein said drive means is operative to drive said magnetic medium at a slow speed in response to zero current fed to said at least one toy vehicle whereby a sound of an idling engine is simulated.

7. A system according to claim 1; wherein said characteristic includes at least a pitch of an audible sound.

8. A system according to claim 1; wherein said characteristic includes at least an amplitude of an audible sound.

9. A system according to claim 8; wherein said characteristic also includes a pitch of said sound.

10. An electric toy vehicle system of the type in which at least one controller controls electric power to at least one toy vehicle, comprising:

means for sensing current in said electric power; and means for producing an acoustic output having a characteristic which is varied in response to said means for sensing current; and a second controller controlling electric power to a second toy vehicle independently of the control of electric power to said one toy vehicle by said one controller, and said means for sensing current is effective to sense the total current fed to said one and second toy vehicles, whereby said characteristic is varied in response to the total current fed to said one and second toy vehicles.

11. A system according to claim 10; further comprising a third toy vehicle, said third toy vehicle being uncontrolled by said one and second controllers, and said means for sensing current being operative to sense the total current to said one, second and third toy vehicles.

12. A system according to claim 10; wherein said at least one toy vehicle is a toy car.

13. An acoustic accessory for an electric toy vehicle game of the type having an ac power source, at least first and second electric toy vehicles and first and second controllers independently operable to control at least the amplitude of power applied to respective electric toy vehicles, said accessory comprising:

means for sensing the total current applied to said first and second electric toy vehicles; and means for producing an acoustic output having a characteristic which is varied in response to said means for sensing.

* * * * *